United States Patent [19]

Hicke

[11] 4,296,536

[45] Oct. 27, 1981

[54] METHOD OF MANUFACTURING CARTRIDGE CASES

[75] Inventor: David W. Hicke, Joplin, Mo.

[73] Assignee: Reagent Chemical and Research, Inc., Middlesex, N.J.

[21] Appl. No.: 172,391

[22] Filed: Jul. 25, 1980

[51] Int. Cl.[3] ..... B21D 51/54; B21K 21/04; B23P 15/22

[52] U.S. Cl. ..... 29/1.3

[58] Field of Search ..... 29/1.3, 1.2, 1.21; 72/347, 349, 352, 353, 354, 360

[56] References Cited

U.S. PATENT DOCUMENTS

| | | | |
|---|---|---|---|
| 2,327,936 | 8/1943 | Slater | 29/1.3 X |
| 2,341,667 | 2/1944 | Stacy | 29/1.3 X |
| 2,345,857 | 4/1944 | Newell | 29/1.3 X |
| 2,979,188 | 4/1961 | Duffield | 29/1.3 X |
| 3,061,908 | 11/1962 | Duffield | 29/1.3 X |
| 3,203,218 | 8/1965 | Bolt . | |
| 3,893,326 | 7/1975 | Oberländer et al. . | |
| 4,038,859 | 8/1977 | Pavleszek . | |
| 4,129,024 | 12/1978 | Deveney . | |

*Primary Examiner*—Horace M. Culver

*Attorney, Agent, or Firm*—Lerner, David, Littenberg & Samuel

[57] ABSTRACT

A method is taught of manufacturing cartridge cases having a substantially cylindrical outer side wall surface and a tapered inner side wall surface. The method comprises the steps of initially forming a cup-shaped article having substantially cylindrical inner and outer side wall surfaces, a substantially flat outer bottom surface with an annular chamfered surface joining the flat outer bottom surface to the outer side wall and an inner bottom wall surface. Thereafter, the cup-shaped article is engaged by a punch element and the punch element forces the cup-shaped article through a series of die members without any intermediate annealing of the article after passage through any of the die members. The punch element has an outer side wall and a bottom wall, the bottom wall being dimensioned so that the diameter of the peripheral edge of the bottom wall is substantially the same as the diameter of the peripheral edge of the inner bottom wall surface of said cup-shaped article whereby at least the peripheral edge of the bottom wall of the punch element will contact the peripheral edge of the inner bottom wall surface of the cup-shaped article when the punch element engages the cup-shaped article to thereby align the punch element and the cup-shaped article with one another for forcing the cup-shaped article through the series of die members. The side wall of the punch element is tapered so as to correspond in configuration and dimension to the configuration and dimension of the tapered side wall surface of the cartridge case to be formed. The die members, the cup-shaped article, and the punch element are dimensioned so that the cup-shaped article is only subjected to ironing during passage through the die members to thereby increase the length of the side wall of the cup-shaped article while reducing the thickness of the side wall thereof.

40 Claims, 7 Drawing Figures

METHOD OF MANUFACTURING CARTRIDGE CASES

FIELD OF THE INVENTION

The present invention is directed to a method of manufacturing cartridge cases, and more particularly to an improved method of manufacturing which is less complicated and which results in significant cost savings over prior art methods of manufacturing cartridge cases, as well as which produces cartridge cases having improved characteristics.

BACKGROUND OF THE INVENTION

Ammunition cartridge cases have been manufactured in the past in accordance with various methods and from various types of materials such as brass, aluminum and even steel. Many of these prior art methods require a series of drawing and ironing steps, or have required complicated machines for fabricating the cartridge cases. However, despite the continued work which has gone on in this art and the suggestion of numerous methods and apparatus, prior art methods and apparatus have not proved completely satisfactory in economically fabricating high quality cartridge cases.

Initially, in this regard, as used herein, the term "drawing" is used in its normal sense in referring to the operation wherein a peripheral margin of a flat blank is turned upwardly and simultaneously smoothed by means of a drawing punch and die to form a cup having a wrinkle-free side wall whose thickness is substantially equal to the thickness of the original blank. Subsequent "redrawing" of the cup merely turns up more of the end material into the side wall (without any substantial reduction in wall thickness), thereby elongating the side wall as a result of a substantial reduction in the diameter of the cup.

The term "ironing" is also used in its conventional sense in referring to the operation wherein the side wall of the cup is elongated by reducing its thickness with no appreciable reduction in the inside diameter of the cup. It is generally accomplished by placing the cup on a closely fitting punch or mandrel and forcing the cup and mandrel through an ironing or reducing die whose diameter is slightly less than the outer diameter of the cup, thereby forcing the excess metal back and producing a longer but thinner side wall.

In this regard, it is initially to be noted that special ballastic considerations are involved in the manufacture of cartridge cases. For example, it is desired that cartridge cases be lightweight while at the same time be manufactured from materials having high strength and tear resistance to ensure against jamming or tearing during the firing operation. Generally, much of this strength and toughness is imparted to the material from which the cartridge case is manufactured by virtue of the working of the material during the shaping and forming operations. This is particularly true with respect to brass materials (i.e., copper and zinc alloys). Additionally, in order to prevent fracture of the side wall of the case during firing, cartridge cases generally include an inner side wall surface which tapers outwardly from its base toward its opposite open end (i.e., the side wall thickness decreases along the length of the cartridge case from the base or closed end toward the open end). Still further, in order to provide a highly concentric shell in order to provide desired firing characteristics for the ammunition round, it is most important to maintain the concentricity of the cartridge case (i.e., minimize the variation in wall thickness about the circumference of the formed cartridge case). Concentricity is also important in order to prevent splitting or fracturing of the case during firing. A further ballastic consideration is reloadability, i.e., the capability of utilizing a cartridge case for a number of firings.

Many typical prior art methods of manufacturing catridge cases have involved stamping out circular discs from precision sheeting, and then drawing the disc into a cup-shaped article. Thereafter, the cup-shaped aritcle is forced through a series of drawing and ironing dies to produce the finished cartridge case. The preformed cup-shaped article generally has an outer and inner diameter which is larger than the finished inner and outer diameters of the formed cartridge case. Thus, the series of drawing and ironing operations serve to reduce not only the outside diameter but also the inside diameter, and additionally to reduce the wall thickness of the side walls of the cartridge case from the thickness of the sheeting from which the blank was stamped.

In this regard, because the metal becomes hardened when worked, it has been necessary in the past to interrupt the passing of the article through the die members and to anneal the intermediately formed article before passing it through subsequent dies and thus complete the forming of the article into the finished desired cartridge case. This is particularly true in the case of cartridge cases made from brass.

More specifically, in the past it has generally been necessary to subject the cup-shaped article to several separate annealing operations to recrystallize the elongated grains of the metal before completion of the cartridge case—i.e., after the article has been partially processed and before being passed through subsequent die members. As an example, in some processes, after the disc is formed into a cup-shaped article, an initial annealing operation is required. The annealed cup can then be forced through a first series of dies, employing a first punch element having a smaller diameter than the inside diameter of the cup-shaped article. During this operation, the article shrinks onto the first punch element (i.e., is redrawn) and its wall thickness is also reduced. Thereafter, the article must again be subjected to an annealing operation in order to relieve stresses created by working the metal in its passage through the dies. The cup is then subjected to a second redrawing and ironing operation, a third annealing step, and a final redrawing and ironing operation. It will thus be appreciated that in accordance with these prior art methods the cup-shaped article is subjected to both a number of drawing or redrawing operations (i.e., in which the inner and outer diameters of the cup-shaped article are reduced without a significant reduction in wall thickness) and to a number of ironing operations (i.e., in which only the outer diameter is reduced, to thereby reduce the thickness of the wall). Furthermore, because of the number of these drawing and ironing operations and the concomitant amount of working which takes place, several intermediate annealing operations are required in order to relieve the stresses built up in the metal during each of these series of drawing and redrawing operations.

Those skilled in the art have also appreciated that each of these annealing operations for recrystallizing the elongated grains require a considered expenditure of energy in the form of heat (either electrical energy or combustion energy) as well as substantial amounts of material and labor cost in connection with heating and treating the cup-shaped article prior to further passage through subsequent dies. Still further, in these prior art methods large amounts of complex tooling are required (i.e., separate punch elements for each series of dies, as well as a number of die members for each drawing and ironing operation). Significant expenses are also incurred in using precision sheeting from which the disc is blanked. Furthermore, the use of sheeting results in significant amounts of waste by virtue of the skeleton which remains after the discs have been stamped therefrom. Each of these considerations greatly serves to increase the cost of manufacture of conventional cartridge cases.

It has also been suggested in the past to manufacture the initial cup-shaped article from wire stock in which a slug of material is cut and then subjected to a cold heading operation to extrude the slug into a cup-shaped article. (See for example U.S. Pat. Nos. 2,028,996 and 2,371,716.) However, even in the methods disclosed in these patents, it is still necessary to subject the cup-shaped article to a series of drawing operations which reduce the inside diameter of the article, as well as ironing operations intended to produce the final desired shape of the cartridge case. After each of the drawing operations, it remains necessary to anneal the article before subsequent drawing and ironing operations are performed.

Single step formation by simply drawing a flat sheet of metal into a cup-shaped article and then only ironing the cup-shaped article into a finished product has not been applied to the art of cartridge manufacture in the past. On the other hand, such formation has been utilized in the manufacture of cylindrical seamless containers (see, for example, British Patent Specification No. 625,011; U.S. Pat. No. 2,412,813; and U.S. Pat. No. 3,203,218). However, such prior art methods for forming metal seamless containers would not generally have been considered to be applicable to the manufacture of cartridge cases, particularly in view of the high precision and special shapes and configurations involved in cartridge case manufacture. For example, while prior art container manufacturing techniques have utilized very precise dies having precisely determined diameters, entrance angles and exit angles, the containers which are manufactured all have a constant wall thickness along substantially their length (generally the mouth of the container may be somewhat thicker for forming a seam with the lid). This is in contrast to cartridge cases, which generally include a tapered wall surface which tapers from the base end of the cup-shaped cartridge to the open formed end of the cartridge case. Also, such methods have not previously been applied with respect to containers having large length to diameter ratios such as exist with cartridge cases.

While it has also been suggested in the prior art to attempt to manufacture the cartridge case in a single continuous stroke of a punch element (see for example U.S. Pat. Nos. 2,140,775; 3,977,225; and 4,129,024), each of these prior art methods have required complicated, and therefore expensive, machinery, such as for example coaxially movable punch members, cushions for the dies, etc. These prior art methods have not employed preformed cup-shaped articles which are then only ironed to elongate the side walls while reducing the thickness thereof. Further, generally the punch element which is used to form the cup-shaped article is tapered so that the finished cartridge case will have an inner side wall surface which is tapered.

Consequently, it will be appreciated that a need exists with respect to the manufacture of ammunition cartridge cases for a more economical method of manufacture which still produces a precision cartridge case having good concentricity and with a tapering wall section along its longitudinal length.

SUMMARY OF THE INVENTION

This is accomplished in accordance with the present invention which provides a method of manufacturing cartridge cases. In one aspect, the method comprises the steps of forming a cup-shaped article having an inner side wall surface and an inner bottom wall surface. After formation of the cup-shaped article, the article is engaged with a punch element which forces the cup-shaped article through a series of die members without any intermediate annealing of the article after passage through any of the die members. The punch element has an outer side wall and a bottom wall. The bottom wall is dimensioned so that the diameter of the peripheral edge of the bottom wall is substantially the same as the diameter of the peripheral edge of the inner bottom wall surface of the cup-shaped article whereby at lest the peripheral edge of the bottom wall of the punch element will contact the peripheral edge of the inner bottom wall surface of the cup-shaped article when the punch element engages the cup-shaped article to thereby align the punch element and the cup-shaped article with one another for forcing the cup-shaped article through the series of die members. The side wall of the punch element and the die members are dimensioned in relation to the dimension of the cup-shaped article so that the cup-shaped article is only subjected to ironing during passage through the die members to thereby elongate or lengthen the side wall of the article while also reducing the thickness of the wall thereof. In this manner, a substantially more economical method of manufacturing cartridge cases having improved characteristics is provided which does not require an intermediate annealing of the article after passage through the various die members.

In another aspect of the present invention for manufacturing cartridge cases having a cylindrical outer side wall surface of a predetermined outer dimension and a tapered inner side wall surface of a predetermined configuration and dimension, the method comprises the steps of forming a cup-shaped article having substantially cylindrical inner and outer side wall surfaces, and engaging the formed cup-shaped article with a punch element and forcing the cup-shaped article through a series of die members to produce the cartridge case without annealing the cup-shaped article after passage through any of the die members. The punch element includes a tapered side wall corresponding in configuration and dimension to the predetermined configuration and dimension of the tapered inner side wall surface of the cartridge case to be formed. The inner and outer side wall surfaces of the cup-shaped article and the die members are dimensioned in relation to the configuration and dimension of the punch element so that the cup-shaped article is only subjected to ironing during passage through the die members to thereby increase the length of the side wall of said cup-shaped article while reducing the thickness of the side wall thereof.

In accordance with the preferred embodiment of the present invention, the die members for ironing the side walls of the cup-shaped article are arranged in coaxial alignment in a single apparatus and spaced from one another so that the cup-shaped article is forced progressively, by means of the punch element, through first the die member with the largest diameter and then subsequently through the other die members each of which have progressively smaller diameters, to thereby elongate the side wall of the cup-shaped article while reducing the thickness thereof. Thus, in accordance with the preferred embodiment, after formation of the cup-shaped article, the article is only subjected to an ironing operation during a single continuous stroke of a punch element through a series of die members to produce the finished cartridge case. No drawing operations are performed on the cup-shaped article and further no intermediate annealing operations are required.

Still further, in accordance with this method, it will be appreciated that the apparatus may be of a relatively simple, less complex nature when compared to prior art arrangements for forming cartridge cases. Also, no special materials are required for the formation of cartridge cases.

These features and characteristics all serve to enhance the economics in producing and manufacturing cartridge cases in accordance with the present invention. At the same time, a cartridge case having good concentricity (i.e., minimal variation in wall thickness about the circumference) and the desired ballistic properties (e.g., tapered side walls) may be produced with the method of manufacture of the present invention. This in part is achieved by virtue of the particular shape and configuration of the preformed cup-shaped article in which the diameter of the peripheral edge of the inside bottom surface of the cup-shaped article is substantially the same as the diameter of the peripheral edge of the bottom surface of the punch element so that at least the peripheral edge of the punch bottom wall will contact the peripheral edge of the inner bottom surface of the cup-shaped article when the punch element engages the cup-shaped article to thereby align the punch element and the cup-shaped article with one another for subsequent ironing.

These and further features and characteristics of the present invention will be more apparent from the following description in which reference is made to the enclosed drawings which illustrate a preferred embodiment of the present invention.

DETAILED DESCRIPTION OF THE PREFERRED EMBODIMENT

Figure 7:
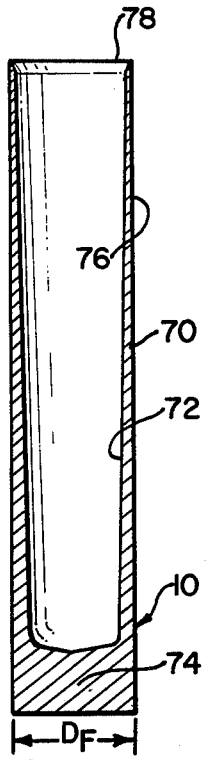
FIG. 7 is an enlarged sectional view of the finished formed cartridge case manufactured in accordance with the present invention.

Referring now to the drawings, wherein like reference characters refer to like elements, there is shown the sequence of operational steps involved in accordance with the preferred embodiment of the present invention for manufacturing cartridge cases such as shown in FIG. 7, as well as various specific relationships of the components and materials employed. For convenience of disclosure, the principles of the present invention will be described hereinafter in connection with the manufacture of small caliber cartridge cases, such as for example a cartridge case for 0.308 caliber ammunition shell, from a brass material having approximately 70% copper and 30% zinc, less impurities. However, the principles involved in the method of the present invention could also be applied with respect to the manufacture of other size cartridge cases from other materials. For instance, the principles in accordance with the present invention could be employed in the manufacture of cartridge case for a wide range of calibers, e.g., ranging from as small as 0.17 caliber up to 0.600 caliber, and even for the manufacture of large artillery casings or projectiles.

Broadly, in accordance with the principles of the present invention, the method comprises in one aspect first forming a cup-shaped article 12 (see FIGS. 1–4) from a desired material, such as brass, to have a side wall 14 and a bottom wall 18. The side wall 14 has outer and inner side wall surfaces 15, 50, and the bottom wall 18 has a substantially flat bottom wall surface 16 and an inner bottom wall surface 52. The diameter of the outer side wall surface 15 of the preformed cup-shaped article 12 is greater than the desired outer diameter of the cartridge case 10 to be formed (shown in FIG. 7). After formation of the cup-shaped article 12, the article 12 is engaged by a punch element 20 and forced through a series of die members 22, 24, 26 to produce the finished cartridge case 10 having the predetermined outer diameter without any annealing of the cup-shaped article 12 after passage through any of the die members 22, 24, 26 (see FIGS. 4–7). The punch element 20 has an outer side wall 94 and a bottom wall 92. The bottom wall 92 is dimensioned so that the diameter of the peripheral edge of the bottom wall 92 is substantially the same as the diameter of the peripheral edge of the inner bottom wall surface 52 of the cup-shaped article 12. In this way, at least the peripheral edge of the bottom wall 92 of the punch element 20 will contact the peripheral edge of the inner bottom wall surface 52 of the cup-shaped article 12 when the punch element 20 engages the cup-shaped article 12 to thereby align the punch element 20 and the cup-shaped article 12 with one another for forcing the cup-shaped article 12 through the series of die members 22, 24, 26. The side wall 94 of the punch element 20 and the die members 22, 24, 26 are dimensioned in relation to the dimension of the cup-shaped article 12 so that the cup-shaped article 12 is only subjected to ironing during passage through the die members 22, 24, 26 to thereby increase the length of the side wall 14 of the cup-shaped article 12 while reducing the thickness of the side wall 14 thereof. In other words, after the cup-shaped article 12 is preformed, it is only subjected to an ironing operation, i.e., an operation in which the side wall 14 is elongated by reducing the thickness thereof with no appreciable reduction in the inside diameter of the cup 12.

Also, broadly in accordance with the present invention, the cartridge cases 10 to be manufactured have a cylindrical outer side wall surface 76 of a predetermined outer dimension and a tapered inner side wall surface 72 of a predetermined configuration and dimension. In this aspect, the inner and outer side wall surfaces 50, 15 of the cup-shaped article 12 are substantially cylindrical. The punch element 20 which is adapted to engage the formed cup-shaped article 12 to force same through the series of die members 22, 24, 26 has a side wall 94 which is tapered so as to correspond in configuration and dimension to the predetermined configuration and dimension of the tapered inner side wall surface 72 of the cartridge case 10 to be formed. Again, the cup-shaped article 12, the die members 22, 24, 26 and the punch element 20 are dimensioned so that the cup-shaped article 12 is only subjected to ironing during passage through the die members 22, 24, 26 to thereby increase the length of the side wall of the cup-shaped article 12 while reducing the thickness of the side wall thereof.

Consequently, because the cup-shaped article 12 is only subjected to ironing (and not to redrawing or drawing), no annealing to relieve stresses created by working of the metal passing through the dies 22, 24, 26 is required. At the same time, the formed cartridge case 10 manufactured in accordance with the present invention is of an improved quality in comparison to cartridge cases manufactured in accordance with conventional techniques. Still further, significant and substantial cost savings are achieved in the practice of the present invention in comparison to prior art manufacturing techniques. In this regard, it is to be noted that these benefits are achieved in part because of the particular configuration and shape of the preformed cup-shaped article 12.

Figure 1:
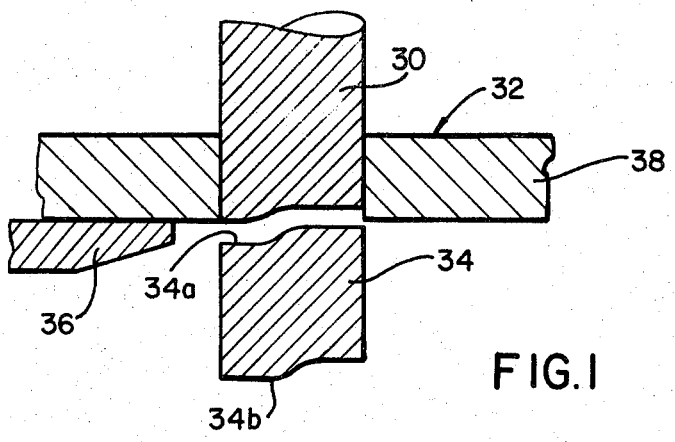
FIG. 1 is a schematic illustration of a slug being sheared from a metallic wire, in accordance with an aspect of the present invention.
Figure 2:
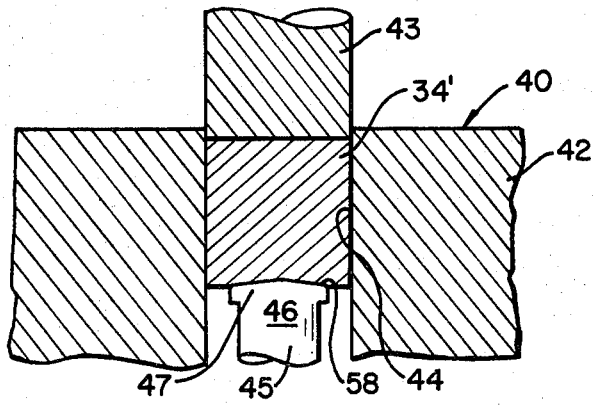
FIG. 2 is a schematic illustration showing a slug positioned in a die element after squaring of the slug, preparatory to extrusion of the slug into a cup-shaped article, in accordance with an aspect of the present invention.
Figure 3:
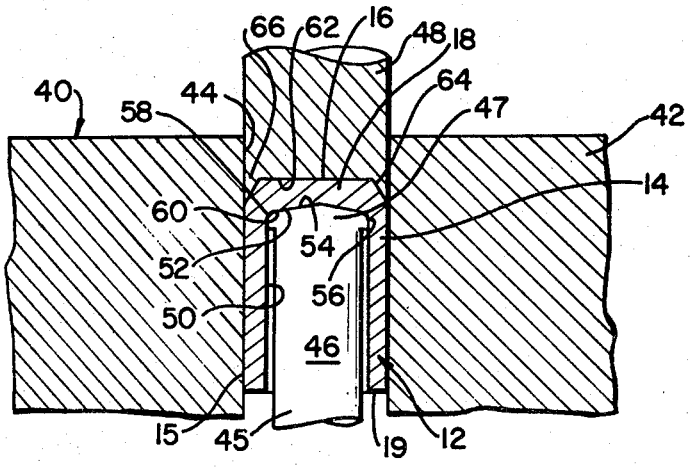
FIG. 3 is a schematic illustration of the slug in the die element after extrusion to form the cup-shaped article in accordance with the present invention.

More particularly, referring to FIGS. 1–3, in accordance with the preferred embodiment of the present invention, the cup-shaped article 12 is formed from wire stock 30 in the form of a cylindrical rod or bar. The wire stock 30, of suitable material for the manufacture of cartridge cases 10, is initially fed longitudinally through a shearing die arrangement 32 which serves to cut or shear a slug 34 therefrom. In this regard, a conventional shearing die arrangement 32 may be employed for this purpose in which one member 36 is arranged for lateral sliding movement relative to the other member 38 to thereby sever a section or length from the wire stock 30. The length of the severed slug 34 is chosen so that a desired volume of material is provided corresponding substantially to or slightly greater than the volume of metal of the finished cartridge case 10. The diameter of the wire stock 30, and thus of the slug 34 may be either greater or smaller than the finished overall desired diameter of the cartridge case 10 to be formed.

After the slug 34 has been cut or sheared from the wire stock 30, it is placed in an extrusion apparatus 40 and subjected first to a squaring operation and then to an extrusion operation to extrude the slug 34 into the desired cup-shaped article 12. In accordance with the preferred embodiment, a reverse extrusion process is utilized; however, it should be appreciated that a forward extrusion process could be employed, or even some other forming operation to form a cup-shaped article 12 having the particular shape in accordance with the present invention.

More particularly, the extrusion apparatus 40 includes an extrusion and squaring die member 42 having an opening or die cavity 44 therethrough with a pin member 46 centrally disposed therein. The cut or sheared slug 34 is initially placed in the die cavity 44 to rest against the centrally disposed pin member 46. Because the end faces **34*a*, 34*b* of the slug 34 when it is sheared from the wire stock may not be entirely flat or square (see FIG. 1), the initial step in forming the preformed cup-shaped article 12 is to square the slug 34 to provide substantially square flat end faces. This is accomplished by first striking the severed slug 34 in the extrusion die cavity 44 with a cold heading punch 43 which serves to slightly deform the sheared slug 34 into a squared slug 34' ready for extrusion (see FIG. 2). The diameter of the slug 34' after squaring is greater than the finished overall desired diameter of the cartridge case 10** to be formed.

Thereafter, an extrusion punch member 48 having an outer diameter substantially the same as the diameter of the extrusion die cavity 44 is moved downwardly into engagement with the squared slug 34' and forced toward the pin member 46. During this process, the slug 34' is extruded about the pin member 46, i.e., the metal is caused to flow downwardly about the sides of the pin member 46 to form the desired cup-shaped article 12. The configuration of the cup-shaped article 12 after extrusion is shown in FIG. 3 and in enlarged section in FIG. 4. It will be appreciated that the dimensions and configuration of the outer surface 15, 16 of the formed cup-shaped article 12 are defined by the extrusion punch member 48 and the die cavity 44, and that the inner dimensions and configuration are defined by the head 47 of the pin member 46.

In this regard, it will be noted that the head 47 of the pin member 46 is of a slightly larger diameter than the shaft portion 45 thereof so that during the extrusion process, the inner side wall 50 of the cup-shaped article 12 will be slightly spaced from the outer surface of the shaft portion 45. This arrangement facilitates the extrusion of the metal slug 34' since the metal does not have to slide along the outer side wall of the shaft portion 45, but rather simply must flow or slide about the head 47 of the pin member 46. That is, the metal simply flows vertically downward, remaining spaced from the surface of the reduced diameter shaft portion 45 of the pin member 46. Thus, it will be appreciated that it is the diameter and configuration of the head 47 which defines the inner diameter and configuration of the cup-shaped article 12. Thus, the cup-shaped article 12 has a substantially cylindrical outer wall surface 15 which corresponds in diameter to the diameter of the die cavity 44 and a substantially cylindrical inner side wall surface 50 which corresponds in diameter to the diameter of the head 47 of the pin member 46.

Further, it will be noted that the upper end face 54 of the head 47 of the pin member 46 is substantially conical so as to produce a concave end or bottom surface 52 for the formed cup-shaped article 12. For example, in the preferred embodiment, the end face 54 of the head 47 is at approximately a 6° angle of inclination from the horizontal. Also, it is to be noted that between this end surface 54 and the side wall 56 of the head 47 a small curved surface 58 is provided which thus produces a corresponding curved surface 60 joining the inner side wall surface 50 and the inner bottom surface 52 of the formed cup-shaped article 12. It should be noted in this regard that this particular configuration of the head 47 of the pin member 46, and thus the configuration of the interior of the formed cup 12, has been chosen mainly in order to provide for ease in extrusion of the cup-shaped article. That is, the end surface 54 of the pin member 46 is conical in order to provide for ease in initially forming a depression in the slug 34', and the provision of a curved or rounded surface 58 between the end surface 54 and side surface 56 of the head 47 is desired in order to avoid possible cutting or shearing of the slug 34' during extrusion.

With respect to the exterior surface configuration and dimensions of the cup-shaped article 12, it is to be noted that the bottom surface 16 is substantially flat and the outer side wall surface 15 is substantially cylindrical. This is produced by the flat portion 62 on the bottom of the extrusion punch 48 and the cylindrical side wall of the die cavity 44. Also, in the preferred embodiment, the closed or base end of the cup-shaped article 12 is provided with an outer annular surface 64 between the flat bottom surface 16 and the cylindrical outer side wall surface 15 of the cup-shaped article 12. It is preferred that this annular surface 64 be chamfered or bevelled (i.e., straight or flat in cross-section), although a rounded or curved annular surface could also be provided. This annular bevelled surface 64 may advantageously be formed during either the squaring operation and/or the extrusion operation on the slug 34' by providing a downwardly directed outer peripheral portion on the cold heading punch 43 and/or the extrusion punch 48 (see for example, the inclined protruding ring portion 66 on the extrusion punch member 48 in FIG. 3). It will be appreciated that the annular surface 64 thus defines the dimension of the flat bottom outer surface 16 on the cup-shaped article 12. That is, the dimension or diameter of the flat bottom outer surface 16 is defined by the circular line between the annular surface 64 and the flat bottom surface 16, i.e., the point of junction of these two surfaces.

Further, it is to be noted that although the side wall 70 of the finished cartridge case 10 is to be tapered or narrowed, as is conventional (i.e., the inner side wall surface 72 tapers outwardly from the base end toward the open end of the case 10, see FIG. 7), both the outer and inner side wall surfaces 15, 50 of the cup-shaped article 12 are substantially cylindrical. The tapered side wall 70 of the formed cartridge case 10 will be formed during the subsequent ironing operation. In this regard, it is to be noted that it is much more difficult and requires a significantly greater force to be applied by the extrusion punch 48 to extrude a slug 34 so as to have a tapered wall section. As a result, if a tapered wall were to be provided on the cup-shaped article 12, the speed at which the extrusion process could be accomplished would be significantly reduced. That is, by extruding an article 12 having a substantially cylindrical or straight side wall in which the wall thickness does not vary along the length, it is possible to extrude articles 12 faster. On the other hand, if a tapered wall were to be provided on the cup-shaped article 12, the speed of extrusion would be significantly less, and probably would require use of several dies, punches, etc. For instance, by extruding the cup-shaped article 12 in the manner in accordance with the present invention, it is possible to extrude cup-shaped articles 12 at a rate up to approximately 250 per minute utilizing conventional cold heading apparatus, whereas only 60–100 cups per minute could be formed if the cups were to have a tapered wall.

As often in the manufacture of cartridge cases it is necessary to provide a thickened bottom wall 74 for the finished cartridge case 10, in accordance with the present invention this thickened bottom wall 74 can, at least in part, be provided by a thickened bottom wall 18 on the cup-shaped article 12. In this regard, it will be appreciated that such a thickened bottom wall 18 on the cup-shaped article 12 can be precisely controlled by simply controlling the extent to which the extrusion punch 48 approaches the end of the head 47 of the pin member 46. As will be discussed more fully hereinbelow, during the subsequent ironing process to lengthen the side wall 14 of the cup-shaped article 12 and reduce the thickness of the side wall 14 thereof, the thickness of the bottom wall 18 of the cup 12 increases slightly, i.e., the bottom wall 74 of the finished cartridge case 10 will become slightly greater than the thickness of the bottom wall 18 of the cup-shaped article 12. Thus, by knowing the amount of increase in thickness during ironing and the desired thickness for the bottom wall 74 of the formed cartridge case 10, the desired thickness of the bottom wall 18 for the cup-shaped article 12 can be determined and then provided by controlling the amount of movement of the extrusion punch 48 toward the pin member 46.

In accordance with the preferred embodiment of the present invention, the dimension of the flat bottom outer surface 16 is substantially the same as or slightly greater than the desired finished outer diameter $D_F$ of the cartridge case 10 to be formed (i.e., the diameter of the outer cylindrical side wall surface 76 of the formed cartridge case 10). That is, if the outer diameter $D_F$ of the formed cartridge case 10 is to be, for example, 0.465 inches, then the diameter $D_B$ of the flat bottom surface 16, i.e., the diameter of the lower inner edge of the annular surface 64, is preferably at least 0.465 inches. However, the diameter $D_B$ of the flat bottom surface 16 may also be slightly greater than the outside finished diameter $D_F$ of the cartridge case 10. By "slightly greater than" it is meant that the diameter $D_B$ of the flat bottom surface 16 may be up to approximately 10% greater than the finished outer diameter $D_F$ of the formed cartridge case 10.

This is advantageous since the chamfered or bevelled surface 64 serves to initially align the cup-shaped article 12 with respect to the ironing dies 22, 24, 26 for ironing of the side wall 14 thereof, and thus aids in providing for improved concentricity (i.e., less variation in wall thickness about the circumference of the formed cartridge case 10) of the formed cartridge case 10 after subsequent passage of the cup-shaped article 12 through ironing dies 22, 24, 26. Although the flat outer bottom surface 16 may be of a smaller diameter than the desired finished outer diameter of the formed cartridge case 10, it is preferred that the diameter be substantially the same as or slightly greater than the finished outer diameter of the cartridge case 10 since this will ensure that the outer bottom surface of the cartridge case 10 will not have a chamfered edge or surface which would otherwise have to be worked or filled out after formation of the cartridge case 10 during sebsequent forming operations to complete the manufacture of an ammunition round. Also, with this arrangement, it is possible to be better able to control the redistribution of the metal during subsequent ironing so as to provide for improved concentricity for the formed cartridge case 10.

After the cup-shaped article 12 has been formed, it is then annealed and washed in order to relief some of the stresses created during the working of the metal and to clean the article for the subsequent ironing thereof, as is conventional in the prior art. The annealing operation of the cup-shaped article 12 may for example comprise heating of the cup-shaped article 12 in an oven or furnace for a given period of time, and then quenching the article 12 with a cold water spray. Generally, scale deposits are built-up on the surface of the cup-shaped article 12 during the annealing operation. Thus, in order to remove this annealing scale, the surface of the cup-shaped article 12 must be cleaned, as for example by pickling the article 12 with a sulfuric-acid solution. Thereafter, the annealed and cleaned cup-shaped article 12 is rinsed and washed with the soap solution, rinsed again and then dried. Preferably, not all of the soap solution is removed during the last rinsing operation as the soap serves as a lubricant during subsequent ironing.

Figure 5:
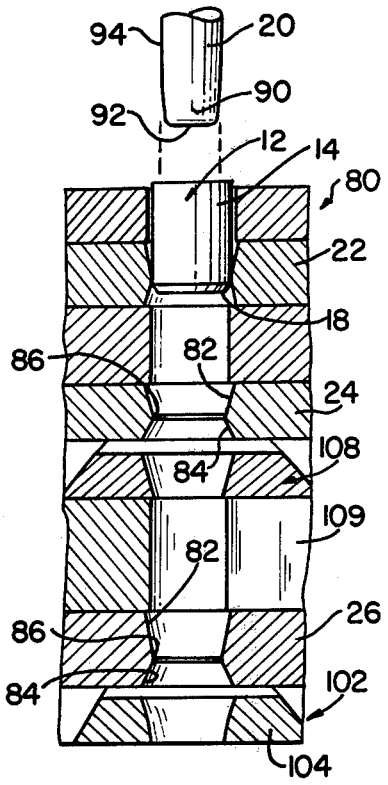
FIG. 5 is a schematic elevational view of an ironing and trimming apparatus which may be utilized in accordance with the method of the present invention, illustrating the position of the cup-shaped article prior to forcing of same through the series of ironing dies.
Figure 6:
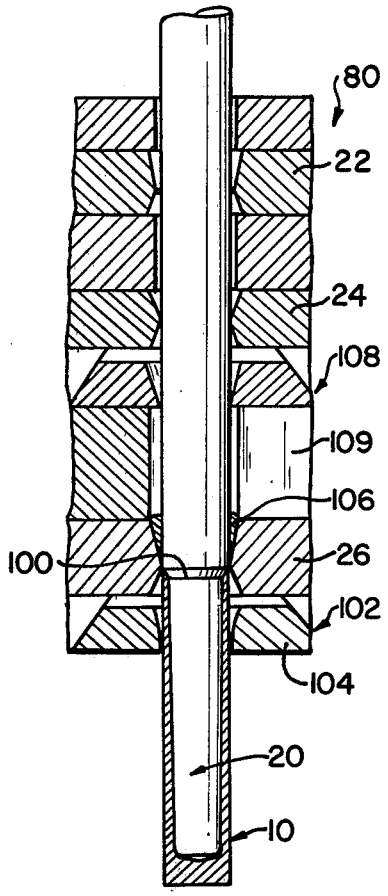
FIG. 6 is a schematic elevational view similar to FIG. 5 but illustrating the position of the cup-shaped article after it has passed through the series of ironing dies and after it has been trimmed therein.

After the cup-shaped article 12 has been formed and treated in the manner described above, it is then ironed and trimmed to complete formation of the finished cartridge case 10. The apparatus 80 for accomplishing this is schematically shown in FIGS. 5 and 6, and preferably comprises a series of die members 22, 24, 26 arranged in coaxial alignment in stacked relationship and a punch member 20 which is adapted to engage the cup-shaped article 12 to force same through the die members 22, 24, 26. In the preferred embodiment, three die members 22, 24, 26 and one punch member 20 are employed. Each of these die members 22, 24, 26 includes an entrance aperture 82, an exit aperture 84 and a die cavity defined by a cylindrical wall section 86 between the entrance and exit apertures 82, 84. The entrance aperture 82 preferably includes a sloping conical wall which is at approximately an angle of 10° (±2°) with respect to the vertical, which angle is conventional with respect to ironing operations of various materials. The internal diameter of the wall section 86 defines the die opening for the die members 22, 24, 26 and thus the outer diameter of the article 12 after it has passed therethrough. The die diameters for the three dies 22, 24, 26 decrease in size going from the uppermost die member 22 to the lowermost die member 26 so that the outside diameter of the cup-shaped article 12 is worked and reduced during passage of the article progressively through the die members 22, 24, 26. That is, the uppermost die 22 has the largest die diameter and the lowermost die member 26 has the smallest die diameter with the intermediate die member 24 having an intermediate die diameter. The die diameter of the lowermost die member 26 corresponds to the finished desired outside diameter $D_F$ of the formed cartridge case 10. The die members 22, 24, 26 may either be axially spaced within the die apparatus 80 so that as the cup 12 progresses through each die member 22, 24, 26 a portion of the cup 12 will still be engaged within the die cavity of the previous die member, or spaced so that the cup-shaped article 12 clears each die member 22, 24, 26 before being engaged by the subsequent die member.

The single punch member 20 which is adapted to engage the cup-shaped article 12 is sized with respect to the internal dimensions of the cup-shaped article 12 so that the wall 14 of the cup-shaped article 12 is only ironed. That is, the punch member 20, the die members 22, 24, 26 and the cup-shaped article 12 are dimensioned such that the side wall 14 of the cup-shaped article 12 is lengthened by reducing the outer diameter without significantly changing the internal diameter of the cup-shaped article 12. Thus, it will be appreciated that during this ironing operation, the cup-shaped article 12 on passing through the first die member 22 is lengthened while the outer diameter thereof is reduced, thus reducing the thickness of the side wall 14 of the cup-shaped article 12. Passage through the second die member 24 further lengthens the side wall 14 and reduces the side wall thickness of the article 12. Finally, passage of the cup 12 through the third die member 26 still further lengthens the side wall 14 and reduces the thickness thereof to complete the formation of the cartridge case 10 having the desired outer diameter, length and wall thickness.

In this regard, as noted above, the thickness of the side wall 70 of the formed cartridge case 10 tapers or decreases from the base of the formed cartridge case 10 to the open upper end 78. This results from the fact that the diameter of the ironing punch 20 progressively increases a slight amount in going from the end or base 90 thereof upwardly. The tapered wall of the punch member 20 may in actuality be made of several tapered sections of different degress of inclination along the length of the punch member 20, as is conventional in the art.

Thus, during passage through the die members 22, 24, 26, the outer surface 15 of the cup-shaped article 12 is progressively decreased by minor amounts to form a substantially cylindrical outer wall surface 76 whose dimension corresponds to the desired outside diameter $D_F$ of the cartridge case 10, and the inner side wall surface 50 of the cup-shaped article 12 is shaped to conform to the shape of the ironing punch 20 to produce the desired tapered inner wall surface 72 spaced from the outer side wall surface 76 an amount corresponding to the desired thickness of the side wall 70 of the cartridge case 10. In this regard, it will be appreciated that since the internal diameter of the cup-shaped article 12 does not significantly change during the forcing of the article 12 through the dies 22, 24, 26, the cup-shaped article 12 is only subjected to ironing, and not to redrawing wherein more of the end material of the cup-shaped article would be turned into the side wall without any substantial change in the thickness of the wall taking place.

Figure 4:
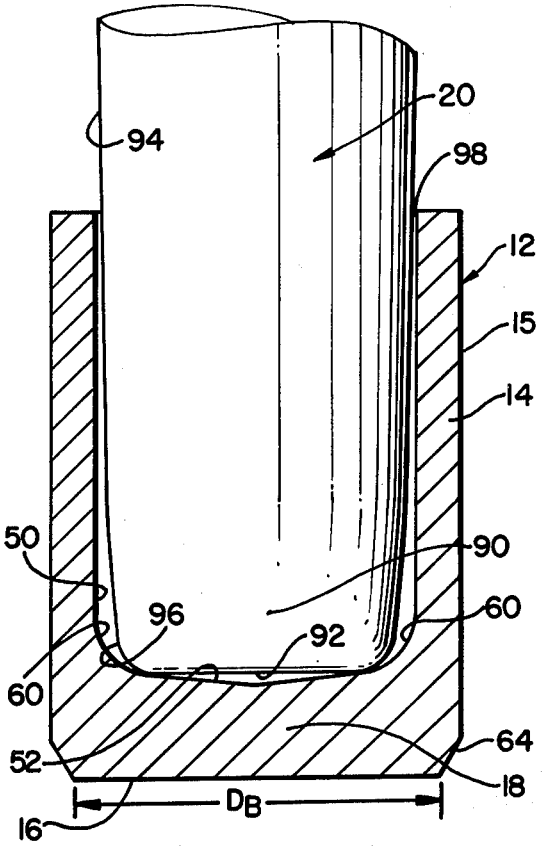
FIG. 4 is an enlarged sectional view illustrating the preformed cup-shaped article in accordance with the present invention with a punch member being positioned in engagement therewith prior to forcing of the cup-shaped article through a series of ironing dies.

In order to achieve a precisely concentric cartridge case 10 in which there is minimal variation in wall thickness about the circumference of the cartridge case 10 at any particular axial position, the bottom surface 92 of the ironing punch 20 in accordance with the preferred embodiment of the present invention is positioned so as to be precisely aligned with the cup-shaped article 12. More specifically, as best seen in FIG. 4, the end 90 of the punch element 20 includes a bottom surface 92 which is connected to the side wall surface 94 by means of annular surface 96, which in the preferred embodiment is smoothly curved so that the bottom surface 92 and side wall 94 are joined at tangents to the curved annular surface 96. The bottom surface 92 of the punch element 20 is substantially flat and is of a diameter at the peripheral edge percisely corresponding with the diameter of the peripheral edge of the bottom inner surface 52 of the cup 12, i.e., the bottom concave surface 52.

In particular, in the preferred embodiment, at its peripheral edge the bottom concave surface 52 of the cup 12 is tangent to the curved annular surface 60 between the bottom surface 52 and the inner cylindrical side wall 50 of the cup-shaped article 12. (This configuration is defined by the shape of the head 47 of the pin member 46 in the extrusion apparatus 40, see FIG. 3.) Preferably, the radius of curvature of the annular surface 96 on the ironing punch element 20 is less than the radius of curvature on the annular surface 60 on the cup-shaped article 12 so that when the ironing punch element 20 is inserted into the cup 12, the peripheral edge portion of the punch element 20 will at least engage the peripheral edge portion of the bottom surface 52 of the cup-shaped article 12, as can best be seen in FIG. 4. In this regard, because of the difference in radius of curvature of the surface 96 on the punch 20 from the radius of curvature of the annular surface 60 in the cup-shaped article 12, if the punch element 20 is slightly skewed to one side upon engagement with the cup 12, the punch 20 will "slide" or move laterally slightly so that the peripheral edge portions of the bottom surface 92 of the punch 20 and of the inner cup bottom surface 52 will be in alignment and in engagement. For example, if the radius of curvature of the annular surface 60 between the bottom inner surface 52 and the cylindrical inner side wall surface 50 of the cup 12 is 0.080 inches, the radius of curvature of the annular curved surface 96 on the punch element 20 may advantageously be 0.050 inches.

As noted above, the side wall 94 of the punch element 20 tapers outwardly slightly away from the bottom end 90. In order to ensure that the peripheral edge portions of the bottom surfaces 92, 52 of the punch 20 and of the cup 12 engage one another, it is preferred that the taper of the side wall 94 of the punch 20 be such that at the elevation or axial position of the open upper end 19 of the cup-shaped article 12, the diameter of the side wall 94 of the punch 20 is slightly less than the diameter of the inner side wall surface 50 of the cup-shaped article 12 so that a very small gap 98 is provided. In this manner, since the side wall 94 of the punch 20 does not initially engage the inner side wall surface 50 of the cup-shaped article 12, precise alignment of the punch 20 and the cup 12 may be achieved in which the peripheral edge portions of the bottom surfaces 92, 52 of the punch 20 and the cup-shaped article 12 are in engagement. However, if desired, the diameters of the punch element 20 and of the inner side wall surface 50 of the cup 12 could be precisely matched at the axial position of the upper end 19 of the cup 12, or alternatively, the punch 20 and cup 12 could be sized to provide a relatively large gap at the upper end 19 of the cup 12 between the inner side wall surface 50 of the cup 12 and the punch 20. In either event, the punch 20 and the cup 12 will still be precisely aligned by virtue of the peripheral portions of the bottom wall 92 of the punch 20 and of the inner bottom surface 52 of the cup 12 aligning themselves with one another.

During the ironing operation, as the cup-shaped article 12 is forced into and through the first die member 22, a portion of the material of the cup-shaped article 12 will fill in the void in the interior around the end 90 of the punch 20 so that the internal configuration of the finished formed cartridge case 10 will conform to the configuration of the outer surface of the punch 20.

During passage through the first die member 22, the side wall 14 of the cup-shaped article 12 will be lengthened. Also, the thickness of the side wall 14 will be correspondingly reduced depending on the axial position of the section of the cup 12 in relation to the punch element 20 after passage through the die member 22 and on the diameter of the die opening of the first die member 22. Similarly, after passage through the second and third die members 22, 24, the side wall 14 of the cup 12 is further lengthened, thereby resulting in a reduction of the thickness of the side wall 14 corresponding to the axial elevation along the punch 20 and the diameters of the die openings of the second and third die members 24, 26.

The amount of the reduction in thickness of the side wall 14 imparted by passage through each die member 22, 24, 26 is calculated according to the amount of reduction at the axial location of the cup 12 which is subjected to the maximum amount of ironing. Generally, in view of the tapered nature of the side wall 14 of the cup 12 after passage through a die member, this location is at or adjacent to the upper open end 19 of the cup 12.

More particularly, as will be appreciated by persons skilled in the art, in order to calculate the precise diameters for each of the die members 22, 24, 26, the third or last die member 26 is first chosen to correspond to the finished desired outside diameter $D_F$ of the cartridge case 10. The diameter of the second die member 24 is then chosen to be of a slightly larger diameter such that in going from the second die member 24 through the third die member 26, the desired reduction in wall thickness is achieved. The same process is used for determining the dimension of the first die member 26. In this regard, in calculating the diameter for the second die member 24, one may take into consideration the amount of trim scrap which will be created and trimmed from the cup 12 after passage through the third die member 26. That is, the diameter of the second die member 24 is calculated with respect to the axial location on the side wall 14 which will correspond to the upper edge 78 of the formed cartridge case 10 after passage through the third die member 26 (i.e., the axial location after the portion of the material at the upper end of the cup 12 which will form the scrap is subtracted). Also, it will be appreciated that the number of die members which may be utilized in the ironing and trimming apparatus 80 to produce a desired amount of reduction in wall thickness of the preformed cup 12 is dependent both on the maximum amount of ironing which can be accommodated by each die member 22, 24, 26 and on the total amount of ironing or working which the article 12 can accommodate without fracturing of the material during passage through the die members 22, 24, 26. In this regard, with 70–30 brass (i.e., 70% copper, 30% zinc), an approximately 45% reduction in wall thickness for each of the die members 22, 24, 26 is possible. This will produce in accordance with the preferred embodiment an approximately 84–86% reduction in wall thickness at the upper edge 19 of the cup-shaped article 12. However, if different materials are utilized, the percentage of reduction in wall thickness for each of the die member 22, 24, 26 may be different.

For example, in the preferred embodiment being described herein, for ironing a cup-shaped article 12 having an outside diameter of approximately 0.560 inches and an inside diameter of 0.424 inches, the first die member 22 may have a diameter of 0.513 inches, the second die member 24 may have a diameter of 0.484 inches, and the third die member 26 may have a diameter of 0.465 inches. The punch member 20 includes an outwardly tapering wall which at the location of the upper edge of the formed cartridge case 10—i.e., the location of the upper edge 78 of the case 10 (after trimming to the desired length of the case 10) on the punch member 20 after passage through the die members 22, 24, 26—is approximately 0.4453 inches. Thus, during the ironing operation, the wall thickness of the side wall 14 of the cup 12 is reduced from 0.68 inches to approximately 0.00985 inches, an approximately 85.5% reduction.

In the preferred embodiment of the present invention, the ironing and trimming apparatus 80 is also provided with means for trimming of excess material from the end of the cup 12 after passage through the dies 22, 24, 26 so that the formed cartridge case 10 exiting from the apparatus 80 will be of the desired length. However, it should of course be appreciated that employment of such an incorporated trimming apparatus is not necessary for practice of the present invention; instead, other conventional munition trimming equipment could be utilized, such as for example, circular cutters, which trim excess material from the cup 12 after the cup 12 has exited from the ironing apparatus to complete formation of the cartridge case 10.

In the preferred embodiment, this trimming is achieved by a pinch-trim method. More particularly, the punch element 20 includes at a predetermined dimension from its end 90 (corresponding to the desired length of the finished cartridge case 10) an enlarged section 100 whose diameter is the same as or slightly smaller than the die diameter of the third die member 26. As the punch element 20 progresses through the die members 22, 24, 26 and the cup-shaped article 12 has its side wall 14 lengthened, when the enlarged section 100 of the punch member 20 begins to pass through the third die member 26 and reaches the die cavity thereof, the material of the cup 12 thereat will be tightly compressed or pinched between the die wall 86 and the enlarged section 100 on the punch 20, thereby causing the material 106 on the punch 20 located thereabove to be severed from the formed cartridge case 10 on the punch element 20 therebelow. In other words, excess material is trimmed as the enlarged section 100 passes through the third die member 26.

The punch element 20 continues through the third die member 26 to move the formed cartridge case 10 to a position below a stripper-holder mechanism 102 provided on the bottom of the apparatus 80. The stripper-holder mechanism 102, as is conventional, may comprise spring biased stripper members 104 biased radially inwardly. During passage of the cartridge case 10 through the stripper-holder mechanism 102, the stripper members 104 are moved radially outward to allow the cartridge case 10 to pass thereby. When the upper edge 78 of the formed cartridge case 10 passes the stripper members 104, the stripper members 104 snap back to thereby lie above the upper edge 78 of the formed cartridge case 10. The punch member 20 is then retracted. Since the formed cartridge case 10 can not be pulled upwardly with the punch member 20 (because its upper edge 78 is stopped by the bottom sides of the strippers 104), the formed cartridge case 10 slides off the punch member 20. As the punch 20 progresses still further upward, the trimmed scrap of material 106 is stripped off of the punch element 20 by means of a trim stripper-mechanism 108 which may be similar to the stripper-holder mechanism 104. The stripped scrap 106 may then be removed in a conventional manner, such as by compressed air which propels the scrap 106 through an appropriate opening 109 in the apparatus 80 when the punch is moved further upwardly. Of course, there are other techniques which could be employed for removing the stripped scrap 106 from the apparatus.

It should also be noted that the ironing and trimming apparatus 80 shown in FIGS. 5 and 6 may include appropriate means (not shown) for lubricating the cup-shaped article 12 and die faces to assist in the ironing operation during passage of the cup-shaped article 12 through the ironing and trimming apparatus 80. For example, as known in the art, suitable means for injecting a lubricant in the entrance apertures 82 of each of the ironing die members 22, 24, 26 could be provided for this purpose.

As noted above, during the ironing process of the preformed cup-shaped article 12, the side wall 14 of the cup-shaped article 12 is lengthened while the thickness thereof is reduced. As a result of the preferred 45% reduction in wall thickness caused by each of the die members 22, 24, 26, the length of the cup-shaped article 12 is lengthened substantially. For instance, in the embodiment being described herein for the manufacture of cartridge cases 10 for 0.308 caliber ammunition, the length of the finished cartridge case 10 is approximately 2.1 inches. Thus, the length to diameter ratio of the formed case 10 is approximately 4.5 to 1. With the present invention, the length of diameter ratio is preferably at least 4 to 1, and can be as high as 6.3 to 1, or even higher, for other size cartridge cases. This amount of lengthening of the cup-shaped article 12 in comparison to the diameter of the formed case 10 is much greater than has been achieved with respect to prior art cylindrical cup-shaped articles in general which have only been subjected to ironing. Furthermore, the amount of lengthening is achieved in accordance with the present invention without any intermediate annealing operation of the cup-shaped article 12 after passage through any of the die members 22, 24, 26.

With the process of the present invention, significantly improved concentricity of the formed cartridge case 10 is achieved. For instance, with prior art cartridge manufacture, the variation in wall thickness about the circumference of the formed cartridge case 10 is generally required to be maintained at approximately 0.0025 to 0.0035 inches variance in order to achieve acceptable ballistic properties for the formed cartridge case. In some instances, a variance of up to 0.0045 inches has been tolerated. However, in accordance with the method of the present invention, the variance in wall thickness is consistently significantly less than the prior art acceptable limits. For example, with the present invention, typical variance in wall thickness is only on the order of 0.0006 to 0.0008 inches, a reduction in variance of almost 80% from prior art acceptable limits.

While not meant to be bound by the reason why such greatly improved concentricity is achieved, it is applicant's belief that this improved concentricity (generally measured near the top or upper end 78 of the formed cartridge case 10 which is the section which is ironed the greatest and thus subjected to a higher percentage of ironing) results at least in part from the very precise alignment of the preformed cup-shaped article 12 with respect to the punch element 20 and the axially aligned ironing die members 22, 24, 26. This improved alignment is achieved in the present invention, at least in part, by virtue of the very precise alignment of the punch element 20 with the interior of the formed cup-shaped article 12 before the cup-shaped article 12 is forced through the ironing die members 22, 24, 26 (i.e., by virtue of the peripheral edge portions of the bottom surface 92 of the punch 20 precisely corresponding to and mating with the peripheral edge portions of the inner bottom surface 52 of the cup-shaped article 12 when the punch element 20 is inserted into the interior of the cup-shaped article 12). Additionally, the improved alignment is believed to be aided, at least in part, by the chamfered annular surface 64 provided about the circumference of the formed cup-shaped article 12 between the flat bottom outer surface 16 and the cylindrical outer side wall surface 15 which serves to precisely position and align the cup-shaped article 12 when it is placed in the ironing apparatus 80 and engaged by the punch element 20. Still further, it is believed that the improved concentricity also results from the fact that the formed cup-shaped article 12 is only subjected to ironing and is not subjected to redrawing as with many conventional prior art arrangements.

A further significant advantage of the present invention is that no intermediate annealing of the cup-shaped article 12 during passage through the ironing dies 22, 24, 26 is necessary. This results in a very significant cost savings for the manufacture of cartridge cases 10, in comparison to the costs involved with conventional manufacturing techniques which involve at least three drawing operations and two intermediate annealing operations. This cost savings results from savings in energy costs such as involved in heating the annealing furnaces either by gas or electricity, labor costs involved in performing a number of drawing operations and intermediate annealing operations, the cost of chemicals for washing and pickling the annealed articles and the disposal of waste materials. All these costs significantly affect the economics of manufacture of cartridge cases and, by eliminating the series of separate drawing and annealing operations involved in prior art methods, it is possible to achieve significant cost savings, on the order of 60% savings of costs involved in the prior art.

Further cost savings are achieved with the present invention because the cup-shaped article 12 is manufactured from wire stock 30 as opposed to blanking of discs of metal from flat sheets which are then drawn and formed into the final cartridge case. For instance, significant savings are achieved in terms of the scrap and reprocessing of waste. More particularly, with the blanking of the discs out of a flat metal sheet, a skeleton sheet is produced which must be scrapped and reprocessed after the blanking. The skeleton sheet may comprise at least approximately 30% of the amount of original material from which the discs were blanked. On the other hand, with the present invention, only enough material for forming the cup-shaped article 12 need be sheared from the wire stock 30.

Further in this regard, by formation of the cup-shaped article 12 having cylindrical side wall surfaces 15, 50, from wire stock 30 in accordance with the preferred embodiment of the present method, the cup-shaped article 12 may be formed at a rate on the order of 250 per minute. With prior art arrangements for forming of cup-shaped articles from wire stock, generally only 60–80 cups per minute could be manufactured, such as cups as produced in accordance with U.S. Pat. No. 2,023,996 to Sautier. In this regard, it is to be noted that the cup-shaped articles formed from wire stock in the Sautier reference are produced to have generally a tapered wall. Such formation of a tapered wall is much more difficult and requires much greater force to extrude, and consequently the cup-shaped articles only produced at a rate of approximately 60–100 cups per minute. (It also should be noted in this regard that the number of cup-shaped articles which can be formed from flat sheet stock may be significantly greater, on the order of 800 per minute; however, with flat sheet stock, a high waste of material is produced, as noted above.) Thus, in accordance with the present invention, because of the increased rate of production of cup-shaped articles 12 which produces less waste, it is now economically justified to change manufacturing methods. This generally was not the case with prior art methods which did produce less waste but also had a lower production rate, thus not providing any significant economic advantage to switching of manufacturing operations.

Still further, it is to be noted that by a simple machining adjustment, it is possible in accordance with the present invention to custom make a cup for several calibers of ammunition to be manufactured, thereby reducing the amount of waste material after ironing. For instance, with prior art arrangements, because of the great cost involved in the tools and materials, standard sized slugs of material were produced for forming cup-shaped articles which were then used for a variety of different calibers of ammunition. Thus, it can be appreciated that since one standard cup was used for a variety of different ammunition sizes, the amount of material in the standard cup would have to be sufficient for the manufacture of larger sized cartridge cases, thereby resulting in a significantly greater amount of waste when the standard cup is transformed into a smaller size cartridge case for a smaller size ammunition. In other words, the use of standard cups in the prior art for the making of various sizes of ammunition cartridge cases added significantly to the waste.

On the other hand, in accordance with the present invention, the amount of material for forming of the cup 12 can be easily controlled by simply controlling the length of the slug 34 which is cut or sheared from the wire stock 30 while still using generally the same shaped cup 12 for several different sized calibers of ammunition. That is, in accordance with the present invention, the lower end of the cup-shaped article 12 may be used for forming of various sizes of ammunition cartridge cases, each cup 12 for different size cartridge cases varying in turn only by the height of the side wall 14. This allows for greater control of the amount of material used since a custom length cup may be provided for each ammunition size, thereby significantly reducing the amount of waste of material after the ironing operation to form the cartridge case 10.

A further advantage in connection with the use of the method of the present invention is that the thickness of the base or bottom wall 74 of the formed cartridge case 10 can be adjusted and controlled to provide a desired thickness for the formed cartridge case 10. In this regard, it is to be noted that the desired thickness for the bottom wall 74 of the formed cartridge case 10 is dependent on the metallurgical parameters for the formed cartridge case 10 (i.e., a desired hardness for the base and thus a desired amount of working for the material from which the cartridge case 10 is formed). With the present invention, the desired thickness of the bottom wall 74 of the cartridge case 10 is achieved simply by controlling the spacing of the extrusion punch 48 relative to the head 47 of the pin member 46 to provide a predetermined thickness of the bottom wall 18 of the cup-shaped article 12. More particularly, during the subsequent ironing operation, the thickness of the bottom wall 18 generally increases a small determinable amount. Thus, to provide a desired thickness for the bottom wall 74 on the finished cartridge case 10, it is only necessary to calculate the amount of thickness increase and then choose an appropriate thickness for the bottom wall 18 of the preformed cup 12. The thickness of the bottom wall 18 of the preformed cup 12 is in turn controlled by the difference in distance between the extrusion punch 48 and the pin 46 in the extrusion apparatus 40. For instance, in the embodiment described hereinabove, the desired thickness of the bottom wall 74 of the cartridge case 10 is approximately 0.175 inches. During the ironing operation, the thickness of the bottom wall 18 of the cup 12 increases approximately 0.020 inches. Thus, in order to achieve the desired thickness for the bottom wall 74 of the cartridge case 10, the extrusion apparatus 40 is controlled so that the bottom surface 62 of the punch 48 stops at 0.155 inches from the end surface 54 of the head 47 of the pin member 46 to thereby provide a bottom wall thickness on the cup 12 of approximately 0.155 inches.

On the other hand, in the prior art methods in which the cartridge case is formed from a blank cut from a flat sheet, the thickness of the bottom wall of the cup, and thus the thickness of the bottom wall of the formed cartridge case, is dependent on the thickness of the strip. As can be appreciated, to achieve a desired bottom wall thickness for the finished cartridge case, it may be necessary to provide a significantly greater thickness of the sheet which thus may serve to significantly increase the amount of waste.

A still further advantage in accordance with the present invention in which the preformed cup 12 is formed from wire stock 30 is that the wire stock 30 has a preferred uniform grain orientation so that the preformed cup-shaped article 12 will also have a preformed, uniform grain orientation, as opposed to a nonuniform grain orientation for the preformed cup formed from flat stock. Since the grain orientation limits the amount of permissible working, significantly more waste may be produced with prior art methods than if the cup 12 is formed from wire stock 30 as in the present invention.

Accordingly, it is seen that in accordance with the present invention an improved method for manufacturing cartridge cases 10 is provided in which the cartridge case 10 has a cylindrical outer side wall surface 76 and a tapered side wall surface 72. The method comprises the steps of forming a cup-shaped article 12 having an inner side wall surface 50 and an inner bottom wall surface 52, and engaging the formed cup-shaped article 12 with a punch element 20 and forcing it through a series of die members 22, 24, 26 to produce the cartridge case 10 without annealing the cup-shaped article 12 after passage through any of said die members 22, 24, 26. The punch element 20 has an outer side wall 94 and a bottom wall 92. The bottom wall 92 is dimensioned so that the diameter of the peripheral edge of the bottom wall 92 is substantially the same as the diameter of the peripheral edge of the inner bottom wall surface 52 of the cup-shaped article 12. In this way, at least the peripheral edge of the bottom wall 92 of the punch element 20 will contact the peripheral edge of the inner bottom wall surface 52 of the cup-shaped article 12 when the punch element 20 engages the cup-shaped article 12 to thereby align the punch element 20 and the cup-shaped article 12 with one another for forcing the cup-shaped article 12 through the series of die members 22, 24, 26. The side wall 94 of the punch element 20 and the die members 22, 24, 26 are dimensioned in relation to the dimension of the cup-shaped article 12 so that the cup-shaped article 12 is only subjected to ironing during passage through the die members 22, 24, 26 to thereby increase the length of the side wall 12 of the cup-shaped article 12 while reducing the thickness of the side wall 14 thereof.

Further, in another aspect of the present invention, the inner and outer side wall surfaces 50, 15 of the cup-shaped article 12 are formed to be substantially cylindrical. The punch element 20 for engaging the cup-shaped article 12 and forcing it through the series of die members 22, 24, 26 has a side wall 94 which is tapered so as to correspond in configuration and dimension to the desired tapered inner side wall surface 72 of the cartridge case 10 to be formed. Again, the cup-shaped article 12, the die members 22, 24, 26, and the punch element 20 are dimensioned so that the cup-shaped article 12 is only subjected to ironing during passage through the die members 22, 24, 26 without any intermediate annealing of the cup-shaped article 12 after passage through any of the die members 22, 24, 26 being required.

While the preferred embodiment of the present invention has been shown and described, it will be understood that such is merely illustrative and that changes may be made without departing from the scope of the invention as claimed.

What is claimed is:

1. A method of manufacturing cartridge cases comprising the steps of:

providing an initial workpiece having substantially flat upper and lower surfaces;

forming a cup-shaped article from said workpiece without any intermediate annealing operations during formation of such cup-shaped article, said formed cup-shaped article having a side wall, a bottom wall defined by inner and outer bottom wall surfaces, and an upper open end, said outer bottom wall surface of said cup-shaped article being formed from said substantially flat lower surface of said initial workpiece; and engaging said formed cup-shaped article with a punch element and forcing said cup-shaped article through a series of die members to produce said cartridge case without annealing said cup-shaped article after passage through any of said die members, said punch element having an outer side wall and a bottom wall, said bottom wall of said punch element being dimensioned so that the diameter of the peripheral edge of said bottom wall is substantially the same as the diameter of the peripheral edge of said inner bottom wall surface of said cup-shaped article whereby at least said peripheral edge of said bottom wall of said punch element will contact the peripheral edge of said inner bottom wall surface of said cup-shaped article when said punch element engages said cup-shaped article to thereby align said punch element and said cup-shaped article with one another for forcing said cup-shaped article through said series of die members, and the side wall of said punch element and said die members being of predetermined dimensions in relation to the dimensions of said cup-shaped article so that said cup-shaped article is only subjected to ironing during passage through said die members to thereby increase the length of the side wall of said cup-shaped article while reducing the thickness of the side wall of said cup-shaped article, and so that the thickness of said side wall of said cup-shaped article at a point adjacent the upper open end thereof is reduced during passage through said die members by at least 65%.

2. The method of claim 1 wherein said side wall of said cup-shaped article includes an inner side wall surface and an outer side wall surface; wherein said cup-shaped article further includes an inner annular surface joining said inner side wall surface to said inner bottom wall surface of said cup-shaped article; wherein said punch element further includes a punch annular surface joining said side wall to said bottom wall of said punch element; wherein the diameter of said inner side wall surface of said cup-shaped article at the location where said inner side wall surface is joined to said inner annular surface is greater than the diameter of said side wall of said punch element at the location where said side wall is joined to said punch annular surface; and wherein the diameter of said side wall of said punch element progressively increases along its length away from the point of connection to said punch annular surface.

3. The method of claim 2 wherein said cup-shaped article has an upper edge portion joining said inner and said outer side wall surfaces of said cup-shaped article; and wherein the diameter of said side wall of said punch element at the location along its length which is juxtaposed to the upper edge of said cup-shaped article when said punch element engages said cup-shaped article is less than the diameter of said inner side wall surface of said cup-shaped article at said upper edge.

4. The method of claim 3 wherein said inner and outer side wall surfaces of said cup-shaped article are substantially cylindrical.

5. The method of claim 4 wherein said inner annular surface of said cup-shaped article is curved having a predetermined radius of curvature, and wherein said punch annular surface is curved and has a radius of curvature which is less than said predetermined radius of curvature.

6. The method of claim 5 wherein said bottom wall of said punch element is substantially flat, and wherein said inner bottom wall surface of said cup-shaped article is substantially concave.

7. The method of claim 1 wherein said cup-shaped article is formed to have an outer side wall surface, a substantially flat outer bottom wall surface, and an outer annular surface joining said substantially flat outer bottom surface to said outer side wall surface of said cup-shaped article.

8. The method of claim 7 wherein said outer annular surface is bevelled with respect to said flat outer bottom wall surface and said outer side wall surface of said cup-shaped article.

9. The method of claim 8 in which said cartridge case to be formed has a cylindrical outer side wall surface of a predetermined outer diameter, and wherein the diameter of said flat outer bottom wall surface of said cup-shaped article is substantially the same as or slightly greater than said predetermined outer diameter.

10. The method of claim 9 wherein the diameter of said flat outer bottom wall surface of said cup-shaped article is substantially the same as said predetermined outer diameter.

11. The method of claim 7 wherein said step of providing an initial workpiece comprises cutting a metal wire to provide a slug; and wherein said step of forming a cup-shaped article from said workpiece comprises extruding said slug into said cup-shaped article.

12. The method of claim 11 further including the step of squaring said slug prior to said step of extruding.

13. The method of claim 12 wherein said outer annular surface on said cup-shaped article is formed during said squaring and extruding steps.

14. The method of claim 13 wherein said steps of squaring and extruding comprise placing said slug in an extrusion die having a pin member positioned therein to support said slug in said extrusion die, and striking said slug with a cold heading punch to square said slug, and then forcing an extrusion punch into said extrusion die into engagement with said squared slug to extrude said slug into said cup-shaped article.

15. The method of claim 1 wherein the number of die members of said series of die members is at least three.

16. The method of claim 15 wherein said at least three die members are coaxially aligned and spaced from one another, and wherein the axis of said punch element is coaxially aligned with the axis of said at least three die members so that said punch element may progressively force said cup-shaped article through said at least three die members in a single continuous stroke, the diameter of each of said die members being less than the diameter of the preceding die member through which said article is forced so that the thickness of said side wall of said cup-shaped article progressively decreases as said cup-shaped article is forced through said aligned die members.

17. The method of claim 11, wherein the diameters of said die members in relation to the dimension of said cup-shaped article and said punch element are such that the thickness of said side wall of said cup-shaped article at a point adjacent the upper open end thereof is reduced during passage through said die members by at least 80%.

18. The method of claim 16 wherein each of said die members includes an entrance aperture having a side wall which is inclined at an angle of about 10° with respect to the axis of said die members.

19. The method of claim 1 wherein said cartridge case to be formed has a cylindrical outer side wall surface of a predetermined diameter and wherein the dimensions of said die members, said punch element and said cup-shaped article are such that the ratio of the length of said formed cartridge case to said predetermined diameter of said cartridge case is at least four to one.

20. The method of claim 1 further including the step of annealing said cup-shaped article prior to the step of engaging said cup-shaped article with said punch element.

21. The method of claim 1 further including the step of trimming excess material from the open end of said cup-shaped article after passage through said die members.

22. The method of claim 21 wherein said step of trimming comprises providing an enlarged portion on said punch element having an increased diameter which is slightly less than the diameter of the last die member in said series of die members so that a portion of the material of said cup-shaped article is pinched between said enlarged portion of said punch element and said last die member as said enlarged portion approaches and passes through said last die member to thereby sever the material of said article thereat to thereby complete formation of said cartridge case.

23. A method of manufacturing cartridge cases having a cylindrical outer side wall surface of a predetermined outer diameter and a tapered inner side wall surface of a predetermined configuration and dimension, the method comprising the steps of:

providing an initial workpiece having substantially flat upper and lower surfaces;

forming a cup-shaped article from said workpiece without any intermediate annealing operations during the formation of said cup-shaped article, said cup-shaped article having a side wall defined by substantially cylindrical inner and outer side wall surfaces, a bottom wall defined by inner and outer bottom wall surfaces, and an upper open end, the diameter of said outer side wall surface of said cup-shaped article being greater than said predetermined outer diameter and said outer bottom wall surface being formed from said substantially flat lower surface of said initial workpiece; and engaging said formed cup-shaped article with a punch element and forcing said cup-shaped article through a series of die members to produce said cartridge case without annealing said cup-shaped article after passage through any of said die members, said punch element including a tapered side wall corresponding in configuration and dimension to said predetermined configuration and dimension of said tapered inner side wall surface of said cartridge case to be formed, and said inner and outer side wall surfaces of said cup-shaped article and said die members being of predetermined dimensions in relation to the configuration and dimensions of said punch element such that said cup-shaped article is only subjected to ironing during passage through said die members to thereby increase the length of the side wall of said cup-shaped article while reducing the thickness of said side wall of said cup-shaped article, and such that the thickness of said side wall of said cup-shaped article at a point adjacent the upper open end thereof is reduced during passage through said die members by at least 65%.

24. The method of claim 23 wherein said punch element has a bottom wall; and wherein the diameter of the peripheral edge of said bottom wall of said punch element is substantially the same as the diameter of the peripheral edge of said inner bottom surface of said cup-shaped article so that at least the peripheral edge of said bottom wall of said punch element will contact the peripheral edge of said inner bottom surface of said cup-shaped article when said punch element engages said cup-shaped article to thereby align said punch element and said cup-shaped article with one another.

25. The method of claim 24 wherein said cup-shaped article further includes an inner annular surface joining said inner side wall surface to said inner bottom wall surface of said cup-shaped article; wherein said punch element further includes a punch annular surface joining said tapered side wall to said bottom wall of said punch element; wherein the diameter of said inner side wall surface of said cup-shaped article at the location where said inner side wall surface of said cup-shaped article is joined to said inner annular surface is greater than the diameter of said tapered side wall of said punch element at the location where said tapered side wall is joined to said punch annular surface; and wherein the diameter of said tapered side wall of said punch element progressively increases along its length away from the point of connection to said punch annular surface.

26. The method of claim 25 wherein said cup-shaped article has an upper edge portion joining said inner and said outer side wall surfaces of said cup-shaped article; and wherein the diameter of said tapered side wall of said punch element at the location along its length which is juxtaposed to the upper edge of said cup-shaped article when said punch element engages said cup-shaped article is less than the diameter of said inner side wall surface of said cup-shaped article at said upper edge.

27. The method of claim 26 wherein said inner annular surface of said cup-shaped article is curved having a predetermined radius of curvature, and wherein said punch annular surface is curved and has a radius of curvature which is less than said predetermined radius of curvature.

28. The method of claim 27 wherein said bottom wall of said punch element is substantially flat, and wherein said inner bottom wall surface of said cup-shaped article is substantially concave.

29. The method of claim 23 wherein said cup-shaped article is formed to have a substantially flat outer bottom wall surface and an outer annular surface joining said substantially flat outer bottom surface to said outer side wall surface.

30. The method of claim 29 wherein said outer annular surface of said cup-shaped article is bevelled with respect to said flat outer bottom wall surface and said outer side wall surface.

31. The method of claim 30 wherein the diameter of said flat outer bottom wall surface is substantially the same as or slightly greater than said predetermined outer diameter of said cartridge case to be formed.

32. The method of claim 31, wherein the diameter of said flat outer bottom wall surface is substantially the same as said predetermined outer diameter of said cartridge case to be formed.

33. The method of claim 29 wherein said step of providing an initial workpiece comprises cutting a metal wire to provide a slug; and wherein said step of forming a cup-shaped article comprises extruding said slug into said cup-shaped article.

34. The method of claim 33 further including the step of squaring said slug prior to said step of extruding.

35. The method of claim 34 wherein said outer annular surface on said cup-shaped article is formed during said squaring and extruding steps.

36. The method of claim 35 wherein said steps of squaring and extruding comprise placing said slug in an extrusion die having a pin member positioned therein to support said slug in said extrusion die, and first striking said slug with a cold heading punch to square said slug, and then forcing an extrusion punch into said extrusion die into engagement with said squared slug to extrude said slug into said cup-shaped article.

37. The method of claim 24 wherein the number of die members of said series of die members is at least three.

38. The method of claim 37 wherein said at least three die members are coaxially aligned and spaced from one another, and wherein the axis of said punch element is coaxially aligned with the axis of said at least three die members so that said punch element may progressively force said cup-shaped article through said at least three die members in a single continuous stroke, the diameter of each of said die members being less than the diameter of the preceding die member through which said article is forced so that the thickness of said side wall of said cup-shaped article progressively decreases as said cup-shaped article is forced through said aligned die members.

39. The method of claim 24 wherein the dimensions of said die members, said punch element and said cup-shaped article are such that the ratio of the length of said formed cartridge case to said predetermined outer diameter of said cartridge case is at least four to one.

40. The method of claim 23 wherein the diameters of said die members in relation to the dimensions of said cup-shaped article and said punch element are such that the thickness of said side wall of said cup-shaped article at a point adjacent the upper open end thereof is reduced during passage through said die members by at least 80%.

* * * * *